US009592992B2

(12) United States Patent
Mizuguchi et al.

(10) Patent No.: US 9,592,992 B2
(45) Date of Patent: Mar. 14, 2017

(54) IMAGE FORMING APPARATUS

(71) Applicant: CANON KABUSHIKI KAISHA, Tokyo (JP)

(72) Inventors: Kohei Mizuguchi, Joso (JP); Takanori Sakurai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/966,623

(22) Filed: Dec. 11, 2015

(65) Prior Publication Data

US 2016/0176677 A1 Jun. 23, 2016

(30) Foreign Application Priority Data

Dec. 19, 2014 (JP) ..... 2014-257421
Nov. 27, 2015 (JP) ..... 2015-232328

(51) Int. Cl.

| | |
|---|---|
| ***G06F 11/00*** | (2006.01) |
| ***B65H 85/00*** | (2006.01) |
| ***B65H 5/06*** | (2006.01) |
| ***B65H 29/12*** | (2006.01) |
| ***B65H 29/14*** | (2006.01) |
| ***B65H 29/58*** | (2006.01) |

(52) U.S. Cl.

CPC ..... *B65H 85/00* (2013.01); *B65H 5/062* (2013.01); *B65H 29/125* (2013.01); *B65H 29/14* (2013.01); *B65H 29/58* (2013.01); *B65H 2301/33312* (2013.01); *B65H 2403/942* (2013.01); *B65H 2404/632* (2013.01); *B65H 2511/11* (2013.01); *B65H 2513/412* (2013.01); *B65H 2801/06* (2013.01)

(58) Field of Classification Search

CPC ..... G03G 15/234; G03G 15/231; G03G 2215/00586; B65H 2301/333; B65H 2301/332; B65H 2301/33216; B65H 85/00; B65H 29/125; B65H 2513/412

USPC ..... 399/401

See application file for complete search history.

(56) References Cited

U.S. PATENT DOCUMENTS

| | | | | |
|---|---|---|---|---|
| 4,954,849 A * | 9/1990 | Koike | G03G 15/234 | 271/3.03 |
| 6,292,650 B1 * | 9/2001 | Akiyama | B65H 5/062 | 399/401 |
| 2013/0043415 A1 * | 2/2013 | Misao | G01B 11/028 | 250/559.15 |

FOREIGN PATENT DOCUMENTS

| | | |
|---|---|---|
| JP | 02-008167 A | 1/1990 |
| JP | 2006-298605 A | 11/2006 |

OTHER PUBLICATIONS

Copending, unpublished U.S. Appl. No. 14/988,301 to Kohei Mizuguchi, dated Jan. 5, 2016.

* cited by examiner

*Primary Examiner* — Matthew G Marini
(74) *Attorney, Agent, or Firm* — Fitzpatrick, Cella, Harper & Scinto

(57) ABSTRACT

An image forming apparatus includes an image forming portion forming an image on a sheet, a first sheet conveyance path guiding the sheet to the image forming portion, a second sheet conveyance path guiding the sheet on which an image has been formed by the image forming portion, and a re-conveyance path connecting the second sheet conveyance path and the first sheet conveyance path. The image forming apparatus further includes a connecting path connecting a point on the way of the second sheet conveyance (Continued)

path with a point on the way of the re-conveyance path and is configured to convey a sheet to the re-conveyance path through the connecting path.

25 Claims, 9 Drawing Sheets

IMAGE FORMING APPARATUS

BACKGROUND OF THE INVENTION

Field of the Invention

The present invention relates to an image forming apparatus for forming images on sheets.

Description of the Related Art

Hitherto, an image forming apparatuses such as copying machines, facsimiles and laser printers capable of forming images on a first side (front surface) and a second side (rear surface) of a sheet by using electro-photography system have been provided. When forming images on both sides of a sheet in such image forming apparatus, a toner image is formed on a photosensitive drum, then the toner image is transferred at a transfer portion to a first side of the sheet supplied from a sheet feed portion, and then the toner image is fixed to the sheet at a fixing portion. Thereafter, the sheet having the image fixed to the first side is reversed and conveyed again to the image forming portion via a re-conveyance path, to have an image formed on the second side of the sheet.

Generally, in the conventional image forming apparatus, the time required from starting an image forming operation such as by pressing a copying button to discharging the sheet on which images have been formed on a discharged sheet tray (hereinafter referred to as FCOT) should preferably be as short as possible from the viewpoint of the user. The same applies to the case where duplex image forming is performed.

However, in an apparatus designed so that the re-conveyance path allows images to be formed on both sides of a sheet having a large size, such as A3 size, the re-conveyance path is set long to correspond to the large-sized sheet. When performing duplex image forming on small-sized sheets such as A4-sized sheets using the re-conveyance path, the FCOT during duplex printing becomes undesirably long.

For example, Japanese Patent Application Laid-Open Publication No. 2006-298605 discloses an apparatus having a reverse conveyance path for small-sized sheets for reversing small-sized sheets and a re-conveyance path for re-conveying the small-sized sheets being reversed by the reverse conveyance path toward the image forming portion within the apparatus, with the aim to shorten the FCOT. Further, when re-conveying a large-sized sheet again to the image forming portion on the image forming apparatus, the sheet is conveyed so that a part of the sheet is protruded to the exterior of the apparatus, and then reversed.

Further, Japanese Patent Application Laid-Open Publication No. 02-008167 discloses an image forming apparatus designed to stack reversed sheets on a re-feeding tray. In the disclosed image forming apparatus, a reverse path for small-sized sheets for stacking the reversed small-sized sheets to a re-feeding tray is disposed downstream of a fixing device, and a reverse path for large-sized sheets is disposed downstream of the reverse path for small-sized sheets, with the aim to shorten the FCOT.

However, according to the image forming apparatus disclosed in Japanese Patent Application Laid-Open Publication No. 2006-298605, a reverse conveyance path only for reversing the small-sized sheets is disposed within the apparatus, and as a result, the size of the main body of the apparatus is increased.

On the other hand, regarding the image forming apparatus taught in Japanese Patent Application Laid-Open Publication No. 02-008167, separate reverse conveyance paths are disposed for reversing small-sized sheets and large-sized sheets respectively, so that the size of the main body of the apparatus is increased as a result. Even further, since the sheet having an image formed on the first side is temporarily stacked on the re-feeding tray before being fed to the image forming portion again, the FCOT during duplex printing is elongated and the productivity is deteriorated.

SUMMARY OF THE INVENTION

According to a first aspect of the present invention, an image forming apparatus includes an image forming portion forming an image on a sheet, a first sheet conveyance path guiding the sheet to the image forming portion, a second sheet conveyance path guiding the sheet on which an image has been formed by the image forming portion, a re-conveyance path connecting the second sheet conveyance path and the first sheet conveyance path, a first reverse conveyance portion reversing the sheet conveyed on the second sheet conveyance path and conveying the sheet to the re-conveyance path, a connecting path connecting a point on the way of the second sheet conveyance path with a point on the way of the re-conveyance path, a second reverse conveyance portion reversing the sheet conveyed on the second sheet conveyance path and conveying the sheet to the connecting path, and a control portion configured to control the first reverse conveyance portion and the second reverse conveyance portion such that the sheet is conveyed to the re-conveyance path via the connecting path or not via the connecting path according to sheet size.

According to a first aspect of the present invention, an image forming apparatus includes an image forming portion forming an image on a sheet, a first sheet conveyance path through which the sheet moving toward the image forming portion passes, a second sheet conveyance path through which the sheet onto which an image has been formed by the image forming portion passes, a re-conveyance path connecting the second sheet conveyance path and the first sheet conveyance path, a conveyance unit conveying the sheet from the second sheet conveyance path to the re-conveyance path, a connecting path connecting a point on the way of the second sheet conveyance path and a point on the way of the re-conveyance path, and a control portion controlling whether to have the conveyance unit convey the sheet from the second sheet conveyance path to the re-conveyance path without passing the connecting path or to have the conveyance unit convey the sheet from the second sheet conveyance path to the re-conveyance path via the connecting path, according to sheet size.

Further features of the present invention will become apparent from the following description of exemplary embodiments with reference to the attached drawings.

DESCRIPTION OF THE EMBODIMENTS

First Embodiment

Figure 1:
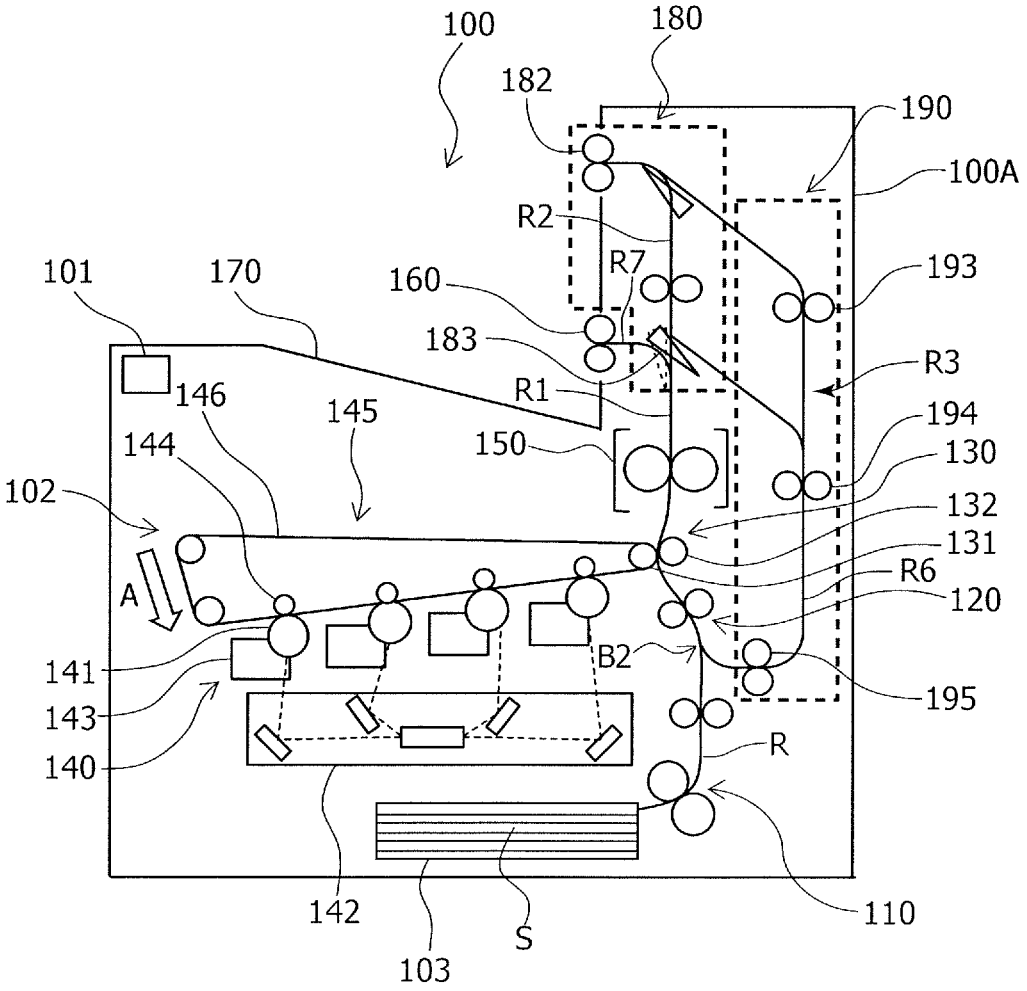
FIG. 1 is a view illustrating an arrangement of a laser printer as an example of an image forming apparatus according to the first embodiment.

Embodiments of the present invention will be explained below with reference to the drawings. FIG. 1 is a view illustrating a configuration of a laser printer as an example of an image forming apparatus according to a preferred embodiment of the present invention. Reference number 100 denotes a laser printer (hereinafter referred to as printer), and 100A denotes a laser printer body (hereinafter referred to as printer body) as an image forming apparatus body. The printer body 100A includes an image forming portion 102 for forming images on sheets S. The printer body 100A also includes a sheet feeding portion 110 for feeding sheets S from a sheet feed cassette 103 as a stacking portion on which sheets are stacked. Further, the printer body 100A includes a reverse mechanism portion 180 and a duplex conveyance portion 190 for re-conveying a sheet on which an image has been formed on a first surface to the image forming portion 102.

The image forming portion 102 includes a scanner unit 142, and four process cartridges 140 each having a photosensitive drum 141, a developer 143 and so on for forming toner images of four colors, which are yellow (Y), magenta (M), cyan (C) and black (Bk). Further, the image forming portion 102 includes an intermediate transfer unit 145 disposed above the process cartridges 140.

The intermediate transfer unit 145 has an intermediate transfer belt 146 wound around a secondary transfer inner roller 131 and the like. The intermediate transfer unit 145 has primary transfer rollers 144 disposed on the inner side of the intermediate transfer belt 146, in contact with the intermediate transfer belt 146 at positions opposing to the photosensitive drums 141. The intermediate transfer belt 146 is arranged in contact with the respective the photosensitive drums 141, and driven by a drive unit not shown to rotate in a direction of arrow A. By applying a transfer bias of positive polarity via the primary transfer roller 144 to the intermediate transfer belt 146, the toner images of respective colors having negative polarity on the photosensitive drums are sequentially transferred in multiple layers onto the intermediate transfer belt 146. Thereby, a full color image is formed on the intermediate transfer belt.

At a position of the intermediate transfer unit 145 opposing to the secondary transfer inner roller 131 is disposed a secondary transfer roller 132 constituting a secondary transfer unit 130 transferring the full-color image formed on the intermediate transfer belt to a sheet S. Further, a fixing portion 150 is arranged above the secondary transfer roller 132, and a discharge roller pair 160 as a first sheet discharge unit is arranged downstream in a sheet transfer direction of the fixing portion 150.

In FIG. 1, 101 denotes a CPU as a control portion for controlling an image forming operation, a sheet feeding operation, and a sheet conveying operation during duplex image forming of the printer 100. R denotes a sheet conveyance path (first sheet conveyance path) guiding the sheet fed from the sheet feeding portion 110 to the image forming portion 102, R1 and R2 denote a sheet conveyance path (second sheet conveyance path) arranged downstream of the first sheet conveyance path in the sheet conveyance direction and guiding the sheet on which an image has been formed by the image forming portion 102, and R7 is a sheet discharge path for discharging the sheet on which the image has been formed by the image forming portion 102. More specifically, R1 is a common conveyance path guiding sheets to a branched portion of the sheet discharge path R7 and the sheet conveyance path R2. Further, R2 is a branched path branched from the common conveyance path R1, through which the sheet having an image formed on a first side passes when forming images on both sides of the sheet. Further, the sheet discharge path R7 is branched from the branched path R2 upstream of the sheet conveyance direction than a first duplex conveyance path 191 described later.

Next, we will describe the image forming operation of the printer 100 arranged as above. When the image forming operation is started, at first, laser beam is irradiated from a scanner unit 142 based on image information from a personal computer and the like not shown. Then, the surface of the photosensitive drum 141 charged uniformly to predetermined polarity and potential is sequentially exposed by the laser beam, and an electrostatic latent image is formed on the photosensitive drum. Thereafter, the electrostatic latent image is developed using toner and visualized. Then, the four-color toner images of yellow (Y), magenta (M), cyan (C) and black (Bk) on the photosensitive drums are transferred via the transfer bias applied on the primary transfer roller 144 to the intermediate transfer belt 146, and a full-color toner image is formed on the intermediate transfer belt. Further, the toner remaining on the photosensitive drum is recovered via a cleaning unit not shown disposed on the process cartridges 140 and collected in a discharged toner container not shown.

Simultaneously as the toner image forming operation, the sheet S stored in the sheet feed cassette 103 is sent out by the sheet feeding portion 110, and thereafter, the sheet S is conveyed to a skew feed correcting unit 120 where skew feed is corrected. Next, in the secondary transfer unit 130, the skew feed correcting unit 120 is driven to match a front end of the sheet S subjected to skew feed correction with a position of the full-color toner image on the intermediate transfer belt, and the sheet S is conveyed to the secondary transfer unit 130. Then, in the secondary transfer unit 130, the full-color toner image is transferred collectively to the sheet S via a secondary transfer bias applied on the secondary transfer roller 132.

Next, the sheet S to which the full-color toner image has been transferred is conveyed to the fixing portion 150, where heat and pressure is applied to melt and mix the respective colored toners, so that the toner image on the sheet S is fixed as a full-color image. Thereafter, the sheet S having the toner image fixed thereto is discharged via the discharge roller pair 160 as sheet discharge unit disposed on the sheet discharge path R7 onto a discharged sheet tray 170 disposed on an upper side of the printer body.

When forming images on both sides of the sheet, a first switching member 183 as guide member is moved from a second position shown by a solid line for guiding the sheet toward the discharge roller pair 160 to a first position for guiding the sheet to the reverse mechanism portion 180 shown by a dotted line. Thus, the sheet having an image formed on the first side is conveyed to the branched path R2 disposed on the reverse mechanism portion 180. Thereafter, the sheet S is reversed in the reverse mechanism portion 180, and the reversed sheet S is re-conveyed via first, second and third conveyance rollers 193, 194 and 195 disposed on the duplex conveyance portion 190 to the secondary transfer unit 130, where an image is formed on a second side opposite to the first side. Then, after the toner image is fixed again at the fixing portion 150, the sheet S having images formed on both sides thereof is discharged via the discharge roller pair 160 onto the discharged sheet tray 170.

Figure 2:
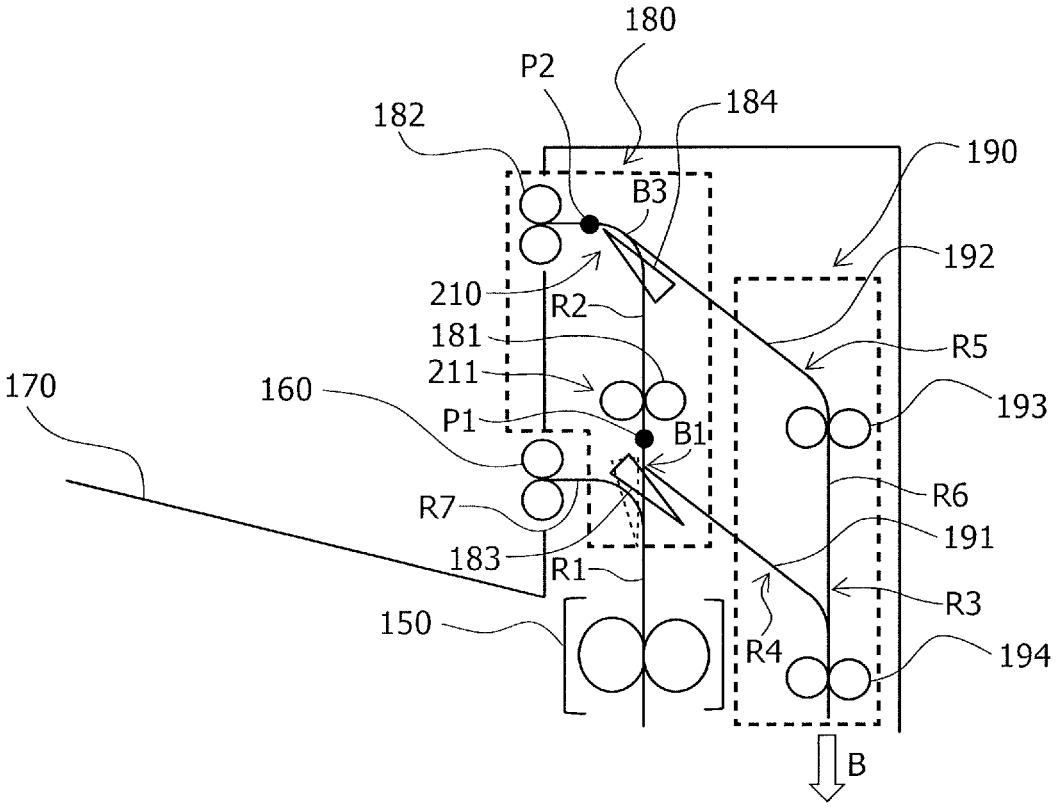
FIG. 2 is a view illustrating an arrangement of a reverse mechanism portion and a duplex conveyance path portion disposed on the above-mentioned laser printer.

Here, as shown in FIG. 2, the reverse mechanism portion 180 includes the first switching member 183 described earlier, a first reversing roller 181 as rotary member capable of bidirectional rotation, a second reversing roller 182 as second sheet conveyance portion capable of bidirectional rotation, and a second switching member 184. The duplex conveyance portion 190 has a second path R6 guiding the sheet conveyed from the reverse mechanism portion 180 to the sheet conveyance path R. Further, as shown in FIG. 1, the second path R6 merges with the sheet conveyance path R at merging point B2 disposed upstream of the skew feed correcting unit 120.

In FIG. 2, R3 is a re-conveyance path having connected the above-mentioned first sheet conveyance path R and second sheet conveyance path R1 and R2, and in the present embodiment, the path R3 is arranged to include the second path R6 and a second duplex conveyance path 192 described later. That is to say, the re-conveyance path R3 can be described as a bypassing path connecting the sheet conveyance path (first sheet conveyance path) upstream of the intermediate transfer unit 145 as the image forming portion and the sheet conveyance path (second sheet conveyance path) downstream of the intermediate transfer unit 145. Further, the second reversing roller 182 and the second switching member 184 constitute a first reverse conveyance portion 210 for reversing the sheet conveyed on the branched path R2 and sending the same to the re-conveyance path R3. That is to say, the second reversing roller 182 can be referred to as a rotary member (first rotary member) capable of bidirectional rotation and arranged downstream, in the sheet conveyance direction, of the branched portion of the re-conveyance path R3 on the second sheet conveyance path R1 and R2, and the second switching member 184 is disposed downstream, in the sheet conveyance direction, of a connecting path 191 described later and upstream, in the sheet conveyance direction, of the branched portion of the re-conveyance path R3, which is a guide unit (first guide unit) capable of being switched between a position for guiding the conveyed sheet toward a rotary member 182 and a position for guiding the sheet reversed and conveyed via the rotary member 182 toward the re-conveyance path R3.

Further, as shown in FIG. 2, the above-described first duplex conveyance path 191 is arranged as a connecting path branched from the branched path R2 at a first branching point B1 between the first reversing roller 181 and the first switching member 183, and conveying the sheet to the second path R6 of the duplex conveyance portion 190. That is, the first duplex conveyance path 191 connects a point on the way of the branched path R2 with a point on the way of the re-conveyance path R3. In other words the branched path R2 is connected in the middle with the middle of the re-conveyance path R3 by the first duplex conveyance path 191. It is noted that the word of "middle" defined as a position that is between two extreme positions, for example between the upstream end and the downstream end in the present embodiment. Further, the first switching member 183 as a second guide portion and the first reversing roller 181 arranged on the second sheet conveyance path R1 and R2 downstream, in the sheet conveyance direction, of the first duplex conveyance path 191 and upstream, in the sheet conveyance direction, of the second reversing roller 182 (first rotary member) constitute a second reverse conveyance portion 211 for reversing the sheet conveyed to the branched path R2 and conveying the same to the first duplex conveyance path 191.

Then, as described later, when re-conveying a small-sized (second size) sheet, the sheet is conveyed along the first switching member 183 to the first duplex conveyance path 191 by the reverse rotation of the first reversing roller 181, and thereafter, conveyed via the re-conveyance path R3 to the sheet conveyance path R. As described, the present embodiment includes the branched path R2, the first duplex conveyance path 191, and the re-conveyance path R3, constituting a re-conveyance path R4 for small-sized sheets as a first circulation conveyance path for re-conveying small-sized sheets to the image forming portion 102. In other words, the re-conveyance path R4 for small-sized sheets includes a portion R2 of the second sheet conveyance path, the connecting path 191, and a portion of the re-conveyance path (a portion of the second path R6), and forms a second reverse duplex conveyance path in which a sheet having a second size is reversed and conveyed to have an image printed on the second side.

Further, the second duplex conveyance path 192 is branched from the branched path R2 at a second branching point B3, and designed to convey the sheet to the second path R6 of the duplex conveyance portion 190 by the reverse rotation of the second reversing roller 182. Then, as described later, when re-conveying a sheet having a size (first size) larger than the small-sized sheet, the sheet is conveyed along the second switching member 184 to the second duplex conveyance path 192 by the reverse rotation of the second reversing roller 182. Thereafter, the large-sized sheet is conveyed via the re-conveyance path R3 to the sheet conveyance path R. As described, in the present embodiment, a re-conveyance path R5 for large-sized sheets including the branched path R2, the second duplex conveyance path 192 and the second path R6 is formed, constituting a second circulation conveyance path for re-conveying large-sized sheets to the image forming portion 102. In other words, the re-conveyance path R5 for large-sized sheets includes a portion R2 of the second sheet conveyance path and the re-conveyance path R3, and forms a first reverse duplex conveyance path in which a sheet having a first size is reversed and conveyed to have an image printed on the second side.

Figure 3:
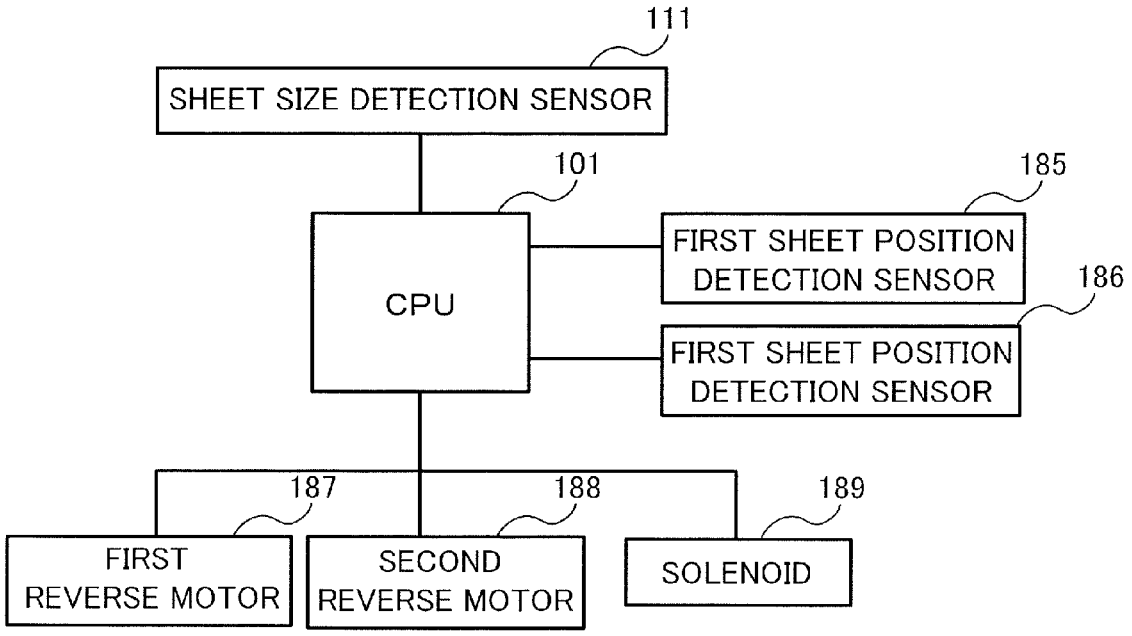
FIG. 3 is a control block diagram of the above-mentioned laser printer.

FIG. 3 is a control block diagram of the printer 100 according to the present embodiment. As shown in FIG. 3, the CPU 101 has a sheet size detection sensor 111 connected thereto as input unit for detecting the sheet size and entering the sheet size information, disposed for example on the sheet feeding portion 110. Further, the CPU 101 has connected thereto a first sheet position detection sensor (second detection unit) 185 disposed between the fixing portion 150 and the first switching member 183 for detecting the sheet position.

Further, the CPU 101 has connected thereto a second sheet position detection sensor (first detection unit) 186 disposed between the second switching member 184 and the second reversing roller 182 for detecting the sheet position, and a first reverse motor 187 for bidirectionally driving the first reversing roller 181. Further, the CPU 101 has connected thereto a second reverse motor 188 for bidirectionally driving the second reversing roller 182, and a solenoid 189 for activating the first switching member 183.

Then, when forming images on both sides of a sheet, the CPU 101 controls either the first reverse conveyance portion 210 or the second reverse conveyance portion 211 to selectively reverse the sheet according to sheet size and convey the sheet to either the re-conveyance path R3 or the first duplex conveyance path 191. That is to say, when forming images on both sides of the sheet, the CPU 101 controls the first reverse conveyance portion 210 or the second reverse conveyance portion 211 to reverse the sheet selectively according to sheet size and convey the sheet to either the re-conveyance path R3 or the first duplex conveyance path 191. In other words, the CPU 101 is configured to control whether to have the conveyance unit, i.e., the first reverse conveyance portion 210 and/or the second reverse conveyance portion 211, convey the sheet from the second sheet conveyance path R1 and R2 to the re-conveyance path R3 without passing the connecting path 191 or to have the conveyance unit convey the sheet from the second sheet conveyance path R1 and R2 to the re-conveyance path R3 via the connecting path 191, according to sheet size.

Figure 4:
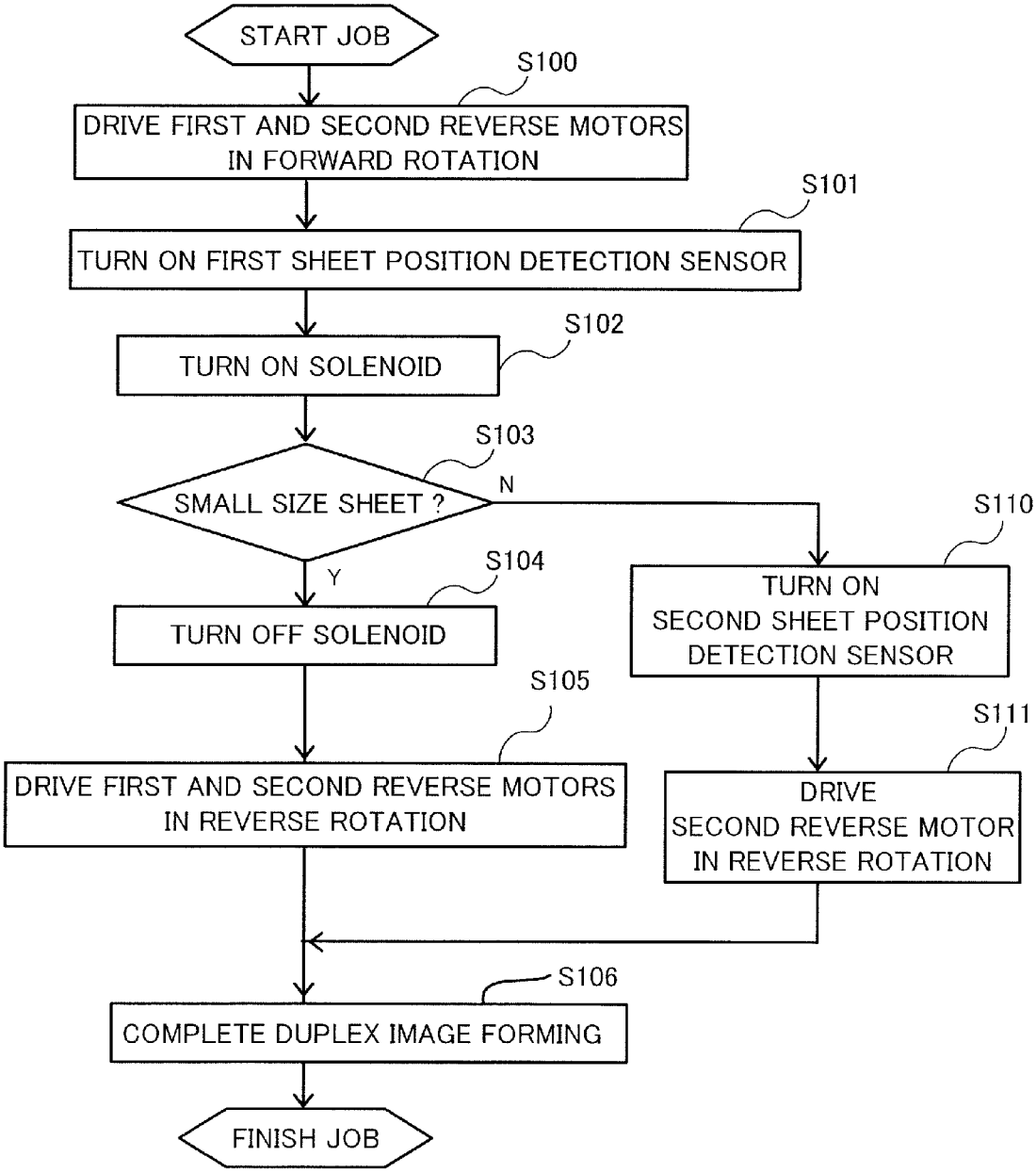
FIG. 4 is a flowchart related to reverse duplex conveyance of the above-mentioned laser printer.

Next, we will describe the control performed in the CPU 101 for performing reverse duplex conveyance. When forming images on both sides of the sheet, at first, the CPU 101 drives the first and second reverse motors 187 and 188 in forward rotation, as shown in the flowchart of FIG. 4 (S100). Then, the first sheet position detection sensor 185 having detected the sheet passing the fixing portion 150 is turned on (S101), and an on signal as a sheet detection signal is entered from the first sheet position detection sensor 185 to the CPU 101. Based on the on signal, the CPU 101 turns the solenoid 189 on (S102), and moves the first switching member 183 from a discharge position shown by the solid line in FIG. 2 to a conveyance position shown by the dotted line.

Thereby, the sheet is conveyed to the reverse mechanism portion 180, conveyed via the forward-rotating first reversing roller 181, and reaches the second switching member 184 positioned at the position illustrated by the solid line by its own weight. Later, when the sheet is conveyed further, the sheet reaches the second reversing roller 82 while pushing up the second switching member 184, and thereafter, a portion of the sheet protrudes from the printer body 100A.

Next, the CPU 101 determines based on the sheet size information entered in advance from the sheet size detection sensor 111 whether the sheet is a small-sized sheet of a LTR size or smaller, or a large-sized sheet greater than the LTR size sheet (S103). When the sheet is a small-sized sheet (S103: Y), the solenoid 189 is turned off (S104), and the first switching member 183 is moved to the discharge position shown by the solid line of FIG. 2.

The CPU 101 rotates the first reverse motor 187 and the second reverse motor 188 in reverse rotation at a timing when a rear end of the sheet reaches a first reverse position P1 between the first switching member 183 and the first reversing roller 181 illustrated in FIG. 2 (S105). Thereby, the first reversing roller 181 and the second reversing roller 182 are rotated in reverse rotation, and the sheet is moved along the upper surface of the first switching member 183 in discharge position toward the first duplex conveyance path 191 and conveyed to the duplex conveyance portion 190. It is preferable to set the first reverse position P1 close to the first switching member 183, since the conveyance distance should be as short as possible from the viewpoint of productivity.

The sheet having been conveyed to the duplex conveyance portion 190 is fed again via a second conveyance roller 194 and a third conveyance roller 195 to the secondary transfer unit 130 where toner image is transferred to the rear surface, and thereafter, the toner image is fixed to the sheet at the fixing portion 150. Thereby, the duplex image forming performed to the sheet is completed (S106). The sheet S having images formed on both sides is conveyed along the bottom surface of the first switching member 183 moved to the discharge position shown by the solid line to the discharge roller pair 160, where the sheet is discharged onto the discharged sheet tray 170.

On the other hand, if the sheet S is a large-sized sheet (S103: N), the sheet is conveyed even after the rear end of the sheet passes the first reverse position P1 illustrated in FIG. 2. The sheet reaches the second reversing roller 182 while pushing up the second switching member 184, and thereafter, the second sheet position detection sensor 186 having detected the same is turned on (S110). Then, an on signal which is a sheet detection signal is entered from the second sheet position detection sensor 186 to the CPU 101. Based on this ON signal, the CPU 101 rotates the second reverse motor 188 in reverse rotation at a timing when the rear end of the sheet reaches a second reverse position P2 between the second switching member 184 and the second reversing roller 182 illustrated in FIG. 2 (S111). Thereby, the second reversing roller 182 is rotated in reverse rotation.

The second switching member 184 is returned by its own weight to the position shown by the solid line of FIG. 2 before the rear end of the sheet passes by and reaches the second reverse position P2. Thereby, when the second reversing roller 182 is rotated in reverse rotation, the sheet travels along the upper surface as a first guide plane of the second switching member 184 to the second duplex conveyance path 192, and is conveyed to the duplex conveyance portion 190. The second reverse position P2 should preferably be set close to the second switching member 184 since the conveyance distance should be as short as possible from the viewpoint of productivity.

The sheet conveyed to the duplex conveyance portion 190 is fed again to the secondary transfer unit 130 via the first conveyance roller 193, the second conveyance roller 194 and the third conveyance roller 195, where a toner image is transferred to the rear surface, and then the toner image is fixed at the fixing portion 150. Thereby, the duplex image forming performed to the sheet is completed (S106). The sheet S having images formed on both sides is conveyed to the discharge roller pair 160 along a bottom surface of the first switching member 183 having been moved to the discharge position shown by the solid line, that is, along a second guide plane on the opposite side from the surface guiding the sheet to the first duplex conveyance path 191, and discharged to the discharged sheet tray 170. As described, according to the present embodiment, when forming images on both sides of the sheet having a second size smaller than the first size, the CPU 101 controls the first reversing roller 181 so that the reversing of the sheet is started at a timing when the rear end of the sheet reaches a position P1 upstream in the second sheet conveyance path than when forming images on both sides of a sheet having the first size.

According to the present embodiment, images are formed on both sides of sheets by circulating a plurality of sheets. In the present embodiment, a length (distance) L1 from the first branching point B1 to the merging point B2 of the re-conveyance path R4 for small-sized sheets is set longer than the length of the small-sized sheet in the sheet conveyance direction and shorter than the length of the large-sized sheet. For example, the length L1 from the first branching point B1 to the merging point B2 is set longer than the LTR or A4-sized sheet, which are frequently used sheet sizes, and shorter than the maximum size of the sheet to which images can be printed on both sides by the printer. Further, the length (distance) L2 from the second branching point B3 to the merging point B2 of the re-conveyance path R5 for large-sized sheets is set longer than the length of the large-sized sheet in the sheet conveyance direction.

In the present embodiment, the sheet feed timing is set so that a subsequent sheet passes the merging point B2 before the sheet having an image formed on the first side passes the re-conveyance path R4 for small-sized sheets or the re-conveyance path R5 for large-sized sheets and reaches the merging point B2. Thereby, duplex image forming of the sheets can be performed by alternately conveying sheets having images formed on the first side and sheets having images formed on the second side.

Figure 5A:
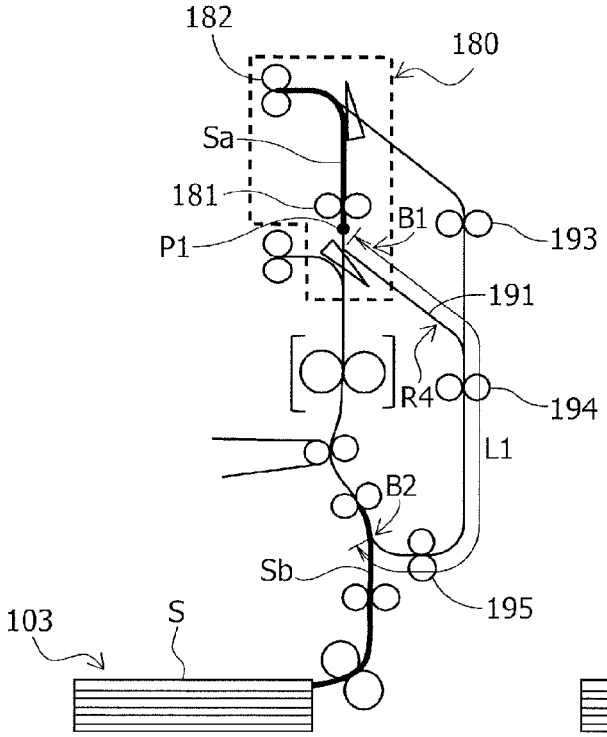
FIG. 5A, is an explanatory view illustrating a circulation path of a small-sized sheet, showing a state where a first sheet has been conveyed to a first reverse position.

Next, we will describe a method for circulating sheets S in the printer 100 according to the present embodiment, where a sheet having an image formed on a first side is circulated, an image is formed on a subsequent sheet, and then the sheet is conveyed to the image forming portion 102 to have an image formed on a second side opposite to the first side. At first, a method for circulating small-sized sheets will be described with reference to FIG. 5. In this case, a first sheet Sa is fed from the sheet feed cassette 103, and an image is formed on the first side of the sheet Sa by the image forming operation described earlier. Thereafter, a second sheet Sb is fed after a fixed interval, as shown in FIG. 5A, before the rear end of the sheet Sa reaches the first reverse position P1.

Figure 5B:
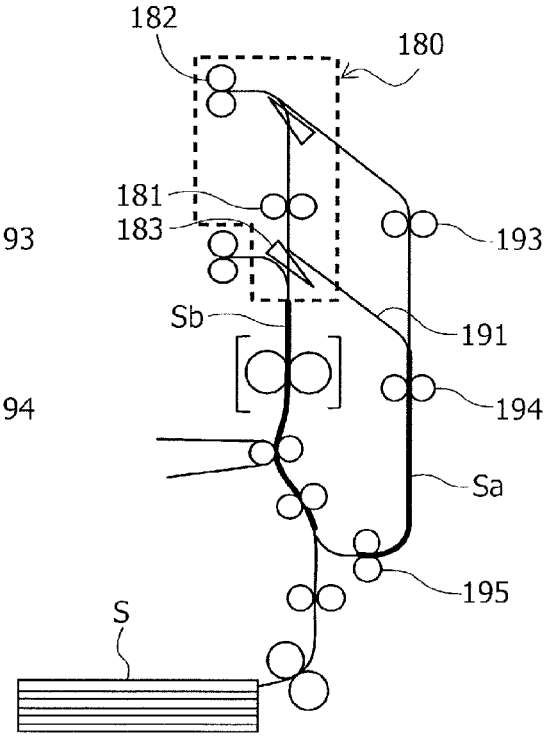
FIG. 5B is an explanatory view illustrating the circulation path of a small-sized sheet, showing a state where the first sheet is being conveyed on a re-conveyance path.

Next, the first sheet Sa is reversed at the first reverse position P1 by the reverse rotation of the first reversing roller 181 and the second reversing roller 182, and passes the first duplex conveyance path 191. Thereafter, as shown in FIG. 5B, when the first reversed sheet Sa is conveyed via the second conveyance roller 194 and the third conveyance roller 195, the second sheet Sb having an image formed on the first side travels toward the first switching member 183. Then, before the second sheet Sb reaches the first switching member 183, the first switching member 183 moves to the conveyance position, so that the second sheet Sb is conveyed to the reverse mechanism portion 180.

Figure 5C:
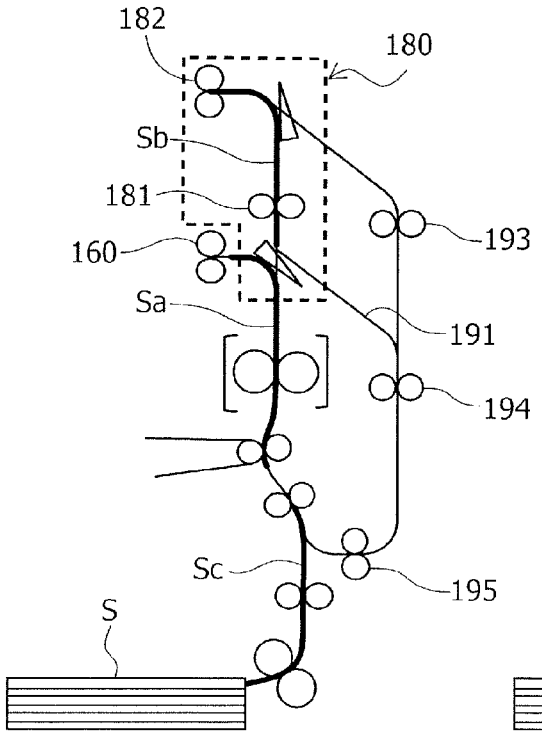
FIG. 5C is an explanatory view illustrating the circulation path of a small-sized sheet, showing a state where image is printed on a second side of the first sheet, and a second sheet has been conveyed to the first reverse position.

Next, an image is formed on a second side of the reversed first sheet Sa, and the sheet Sa travels toward the first switching member 183. Then, before the first sheet Sa reaches the first switching member 183, the first switching member 183 moves to the sheet discharge position. Thereby, as shown in FIG. 5C, the first sheet Sa is conveyed along the first switching member 183 to the discharge roller pair 160. Thereafter, the second sheet Sb reaches the first reverse position P1. Further, a third sheet Sc is fed from the sheet feed cassette 103 so as to follow the first sheet Sa.

Figure 5D:
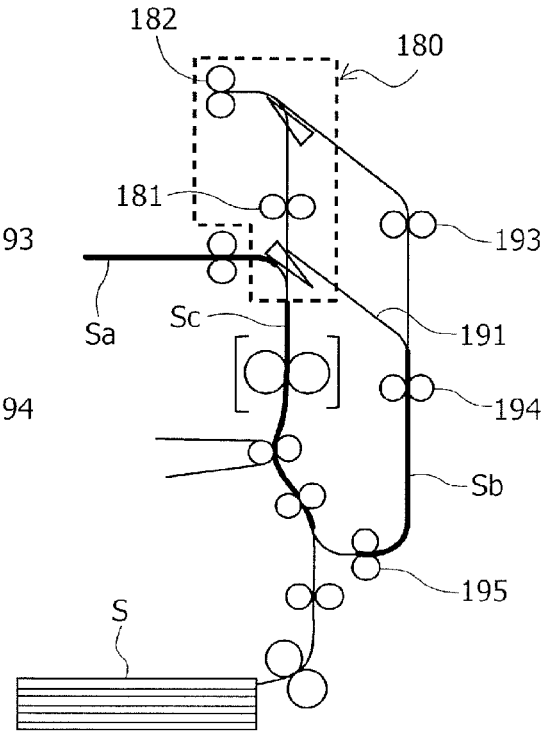
FIG. 5D is an explanatory view illustrating the circulation path of a small-sized sheet, showing a state where the first sheet is discharged, image is printed on the second side of the second sheet, and a third sheet is being conveyed on the re-conveyance path.

Next, as shown in FIG. 5D, around the timing when the first sheet Sa is being discharged, the second sheet Sb is reversed and conveyed via the second conveyance roller 194 and the third conveyance roller 195. The third sheet Sc travels toward the first switching member 183. Before the third sheet Sc reaches the first switching member 183, the first switching member 183 moves to the conveyance position, and the third sheet Sc is conveyed to the reverse mechanism portion 180.

Thereafter, the second sheet Sb travels to the position of the first sheet Sa illustrated in FIG. 5C, and the third sheet Sc travels to the position of the second sheet Sb illustrated in FIG. 5C. Further, a fourth sheet not shown is fed from the sheet feed cassette 103 following the second sheet Sb. By repeating such operation, duplex image forming of sheets is performed by circulating a plurality of small-sized sheets.

Figure 6A:
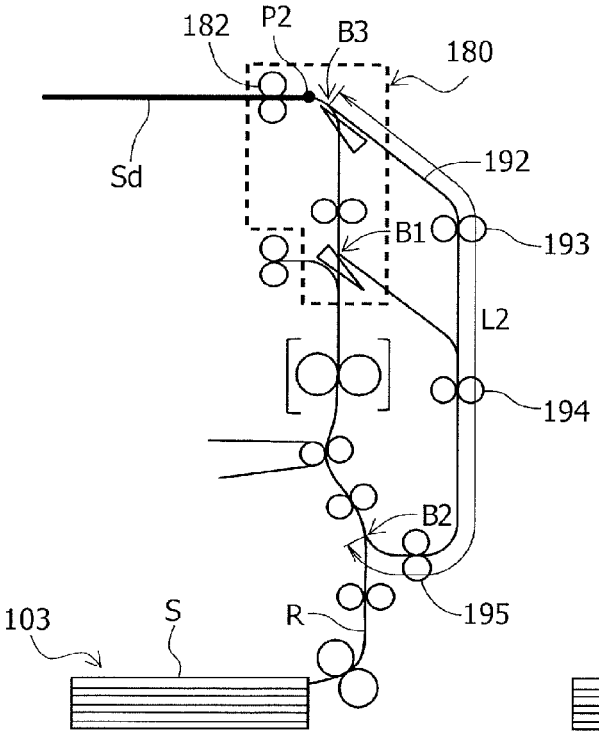
FIG. 6A, is an explanatory view illustrating a circulation path of a large-sized sheet, showing a state where the first sheet has been conveyed to a second reverse position.

Next, the method for circulating large-sized sheets will be described with reference to FIGS. 6A, through 6D. In this case, a first sheet Sd having a large size is fed from the sheet feed cassette 103, and an image is formed on the first side of the sheet Sd through the image forming operation described earlier. After an image is formed to the first side, when the rear end of the sheet Sd reaches the second reverse position P2 as shown in FIG. 6A, the second reversing roller 182 is rotated in reverse rotation. Thereby, the sheet Sd is reversed, and conveyed to the second duplex conveyance path 192. When the sheet Sd is started to be reversed, a second sheet Se is fed.

Figure 6B:
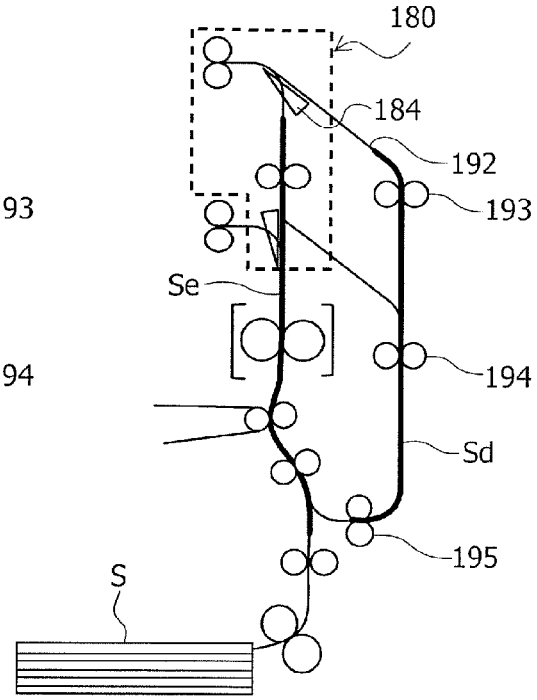
FIG. 6B is an explanatory view illustrating the circulation path of a large-sized sheet, showing a state where the first sheet has been conveyed on the re-conveyance path.
Figure 6C:
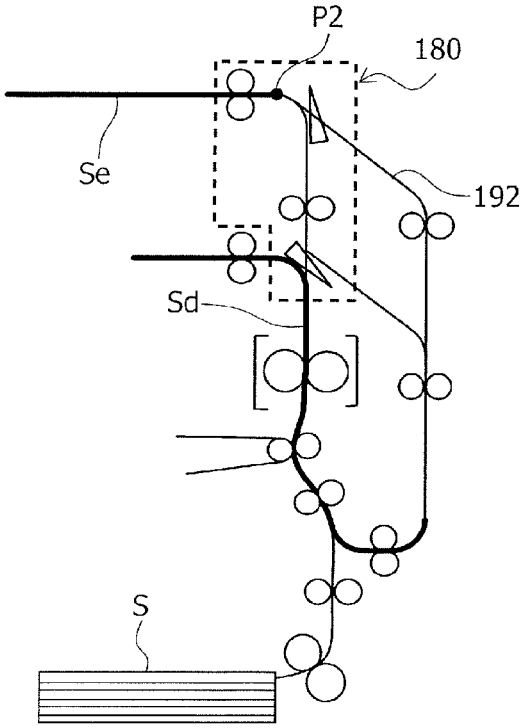
FIG. 6C is an explanatory view illustrating the circulation path of a large-sized sheet, showing a state where image is printed on a second side of the first sheet, and a second sheet has been conveyed to a second reverse position.

As shown in FIG. 6B, when the reversed first sheet Sd starts to be conveyed via the first to third conveyance rollers 193 to 195, a second sheet Se having an image formed on the first side travels toward the second switching member 184. Thereafter, the first sheet Sd is conveyed to the discharge roller pair 160 along the first switching member 183 having been moved to the discharge position, as shown in FIG. 6C, and the second sheet Sb reaches the second reverse position P2.

Figure 6D:
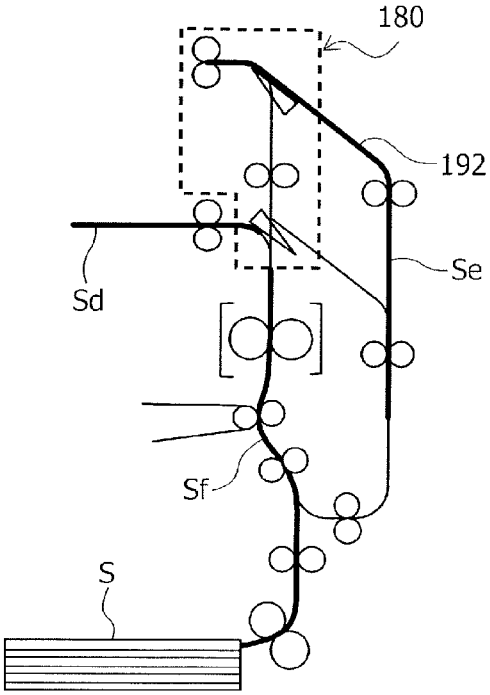
FIG. 6D is an explanatory view illustrating the circulation path of a large-sized sheet, showing a state where the first sheet is discharged, image is printed on a second side of the second sheet, and a third sheet is being conveyed on the re-conveyance path.

Next, as shown in FIG. 6D, around a timing when the first sheet Sa is discharged, a third sheet Sf travels toward the first switching member 183. The second sheet Se is reversed, and conveyed by the first and second conveyance rollers 193 and 194. Thereafter, the second sheet Se is moved to the position of the first sheet Sd illustrated in FIG. 6C, and the third sheet Sc is moved to the position of the second sheet Se illustrated in FIG. 5C. Further, a fourth sheet not shown is fed from the sheet feed cassette 103 following the second sheet Se. By repeating such operation, duplex image forming of sheets is performed by circulating a plurality of large-sized sheets.

By adopting the above-described method for alternately conveying and circulating sheets having images formed on the first side and sheets having images formed on the second side, it becomes possible to set a short distance between sheets in successive duplex image forming, and the productivity of duplex printing can be improved. The present embodiment relates to a method for alternately conveying and circulating sheets having images formed on the first side and having images formed on the second side, but as long as the circulation method enables to achieve equivalent productivity, the method is not specifically restricted to such circulation method.

As described, according to the present embodiment, the branched path R2 and the re-conveyance path R3 are respectively connected at the middle by the first duplex conveyance path 191. Further, when re-conveying a small-sized sheet, the first reversing roller 181 is rotated in reverse rotation to convey the sheet to the first duplex conveyance path 191, by which the conveying distance during conveyance of the small-sized sheet is shortened. In other words, the first reverse conveyance portion 210 and the second reverse conveyance portion 211 are controlled so that the sheet is selectively reversed based on sheet size and conveyed to either the re-conveyance path R3 or the first duplex conveyance path 191. Thereby, the printer body 100A can be downsized and the productivity can be improved.

In further detail, according to the present embodiment, both the small-sized sheet and the large-sized sheet use the branched path (a portion of the second sheet conveyance path) R2 as reverse conveyance path for reversing sheets, and even if there are different circulation paths for the small-sized sheet and the large-sized sheet, there are no dedicated reverse conveyance paths for each size. Even according to such configuration, the first duplex conveyance path 191 is branched from the middle, i.e., a point on the way, of the branched path R2 bypassing the second sheet conveyance path R1 and R2 and the re-conveyance path R3, the small-sized sheet will not be conveyed on a long circulation path enabling a large-sized sheet to be circulated. In addition, at least for the large-sized sheet, the sheet is conveyed by the second reversing roller 182 and reversed on the branched path R2 with a part of the sheet protruded to the exterior of the device, there is no need to form the branched path R2 which is a common reverse conveyance path for the small-sized sheet and the large-sized sheet to have a length longer than necessary. In other words, since the path through which the sheets are conveyed to the reversing position is common, and the sheets are reversed while having a part of the sheet protruded to the exterior of the device, the sheet conveyance path can be shortened and the body of the device can be simplified, contributing to lowering costs and downsizing of the device.

Moreover, since the length of the re-conveyance path R4 for small-sized sheets is made longer than the small-sized sheet and shorter than the large-sized sheet, and the length of the re-conveyance path R5 for large-sized sheets is made longer than the large-sized sheet, a plurality of sheets can be circulated simultaneously on the respective circulation paths including the conveyance path R for small-sized sheets and large-sized sheets, respectively. Therefore, the printer body 100A can be downsized and the productivity can be improved.

In the aforementioned description, when performing successive printing of the small-sized and large-sized sheets, the first duplex conveyance path 191 and the second duplex conveyance path 192 are switched according to sheet size, but the condition for switching paths is not restricted to the above. For example, when performing duplex printing of a single large-sized sheet, it is possible to use the first duplex conveyance path 191. In that case, the duplex conveyance distance is shortened, and the duplex FCOT of the large-sized sheet can also be shortened, so that the productivity can be improved.

On the other hand, the duplex conveyance path can also be switched as described below, other than for purposes such as FCOT and productivity, such as for taking measures against image defects and for adding of sheet discharge units. For example, there are cases where condensation occurs to the first duplex conveyance path 191 by the vapor generated in the fixing portion 150 during image forming. At this time, if condensation has not occurred to the second duplex conveyance path 192, it is possible to switch the reverse duplex conveyance path to the second duplex conveyance path 192 even when re-feeding a small-sized sheet.

Figure 7:
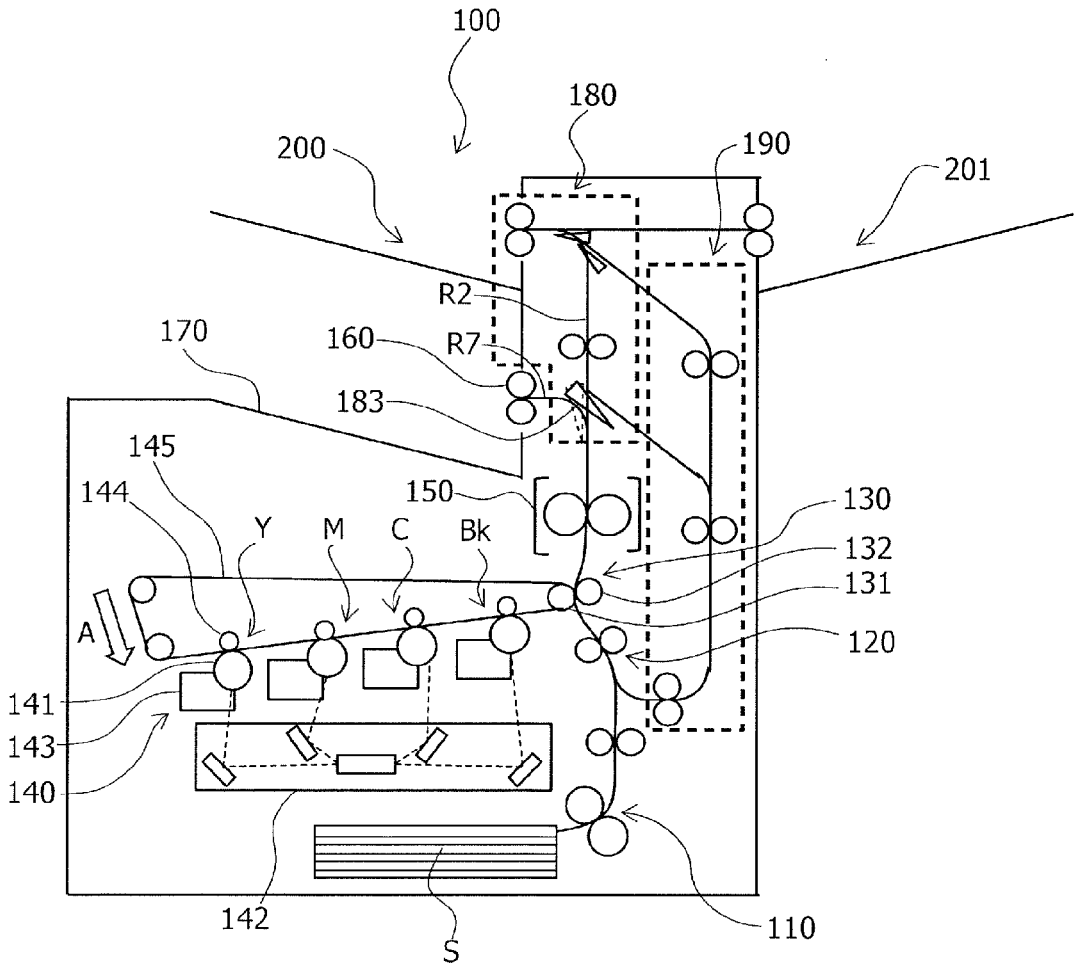
FIG. 7 illustrates a different arrangement of the above-mentioned laser printer.

For example, in addition to the discharge roller pair 160, there are cases where a second sheet discharge portion 200 and a third sheet discharge portion 201 are provided as second sheet discharge unit for discharging sheets having passed the branched path R2, as shown in FIG. 7. In that case, it is possible to discharge the sheets to the exterior of the device using the second reversing roller 182 arranged at the end portion of the second sheet conveyance path, and to switch the first duplex conveyance path 191 and the second duplex conveyance path 192 arbitrarily for the respective sheet discharge portions. Further, according to the present embodiment, since the path through which the sheets are conveyed to the reversing position is common, and the sheets are reversed while having a portion of the sheet protruded to the exterior of the device, the duplex conveyance path of the sheets can be shortened and the device body can be simplified, contributing to lowering costs and downsizing of the device.

Further, two paths, which are the first duplex conveyance path 191 and the second duplex conveyance path 192, are provided according to the present embodiment, but the present invention is not restricted to such configuration, and three or more duplex conveyance paths such as for small-sized sheets, middle-sized sheets and large-sized sheets can be provided.

According to the above description, the second reverse conveyance portion consists of the first switching member 183 and the first reversing roller 181, but the present invention is not restricted to such configuration. For example, the second reverse conveyance portion can consist of the discharge roller pair 160 as rotary members capable of bidirectional rotation disposed on the sheet discharge path, and a guide unit for guiding the sheets in the second sheet conveyance path successively to the second sheet conveyance path. This guide unit can be switched between guiding the sheets from the second sheet conveyance path to the sheet discharge path and guiding the sheets reversed by the discharge roller pair 160 from the sheet discharge path to the connecting path. By adopting such arrangement for the second reverse conveyance portion, it is possible to use the discharge roller pair 160 to reverse the sheet conveyed to the second sheet conveyance path and convey the sheet to the connecting path. Further, it is possible to eliminate the first reversing roller 181 and to use the second reversing roller 182 also as a rotary member of the first reverse conveyance portion for reversing the sheets conveyed on the branched path R2 and conveying the same to the re-conveyance path R3. That is to say, the second reversing roller 182 can be used to reverse both small-sized sheets and large-sized sheets.

Second Embodiment

Now, an image forming apparatus according to a second embodiment will be described with reference to FIGS. 8 and 9. In the following description, only the points that differ from the first embodiment will be described, and similar components are denoted with the same reference numbers as the first embodiment, and descriptions thereof are omitted. In the following description, the second conveyance roller 194 is also referred to as a third rotary member arranged closest to a connecting portion of a first duplex conveyance path (connecting path) 191 on a re-conveyance path R3, and to which a sheet having been reversed and conveyed by a first reverse roller (second rotary member) 181 is transferred. Moreover, the first conveyance roller 193 is also referred to as a fourth rotary member arranged closest to a second reverse roller (first rotary member) 182 on the re-conveyance path R3, and to which a sheet having been reversed and conveyed via the second reversing roller 182 is transferred.

Figure 8:
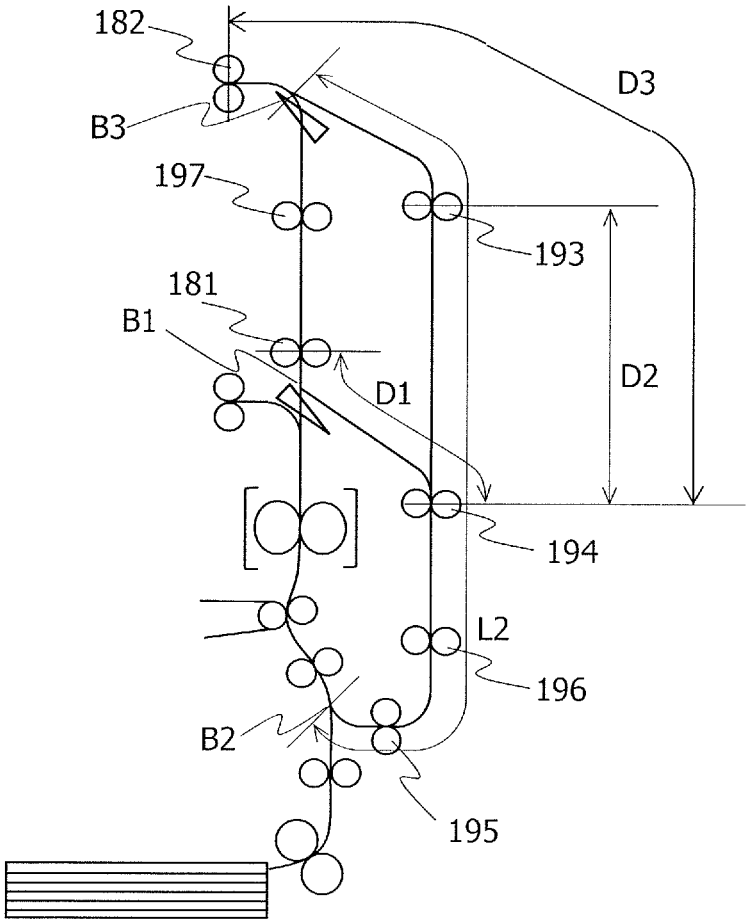
FIG. 8 is an explanatory view illustrating an arrangement of a reverse mechanism portion and a duplex conveyance portion disposed on a laser printer according to a second embodiment.

FIG. 8 is a frame format of a conveyance path portion of a printer having extended the re-conveyance path R5 for large-sized sheets and having added rollers 196 and 197 to the first embodiment. Further according to the present embodiment, rollers 193 and 194 are moved upward, the distance D1 from the roller 181 to the roller 194 on the re-conveyance path R4 for small-sized sheets is made shorter than in the first embodiment, and the distance D2 from the roller 193 to the roller 194 on the re-conveyance path R5 for large-sized sheets is made longer. Further, according to the present embodiment, the method for circulating sheets and the method for controlling the device adopt similar methods as those described in the first embodiment.

The image forming apparatus according to the present embodiment is configured to handle circulation conveyance of larger-sized sheets, by extending the re-conveyance path R5 for large-sized sheets than the first embodiment. Moreover, by adding a roller 196 to the re-conveyance path R4 for small-sized sheets, it becomes possible to correspond to duplex conveyance of smaller-sized sheets.

By extending the re-conveyance path as described in the present embodiment, a length L2 from a branching point B3 to a merging point B2 is extended, so that a larger-sized sheet can be stored in the same section, as described in the first embodiment. Therefore, alternate conveyance of sheets having images formed on the first side and sheets having images formed on the second side can be performed for larger-sized sheets.

On the other hand, in order to enable duplex conveyance of sheets, it is necessary to set the distance between rollers to be shorter than the length in the conveyance direction of the sheet to be conveyed. Therefore, the necessary number of rollers increases as the length of the re-conveyance path becomes longer or as the size of the sheet to be conveyed becomes smaller.

According to the present embodiment, a dedicated path having a short conveyance path length is provided for small-sized sheets, so that the device can cope with duplex conveyance of small-sized sheets by setting only the distance between rollers in the re-conveyance path R4 for small-sized sheets having the short conveyance path length short, as shown in FIG. 8, regardless of the length of the re-conveyance path R5 for large-sized sheets. Therefore, the duple conveyance property of both large-sized sheets and small-sized sheets can be realized simultaneously. According to the present embodiment, it is preferable that a maximum roller distance D1 on the re-conveyance path R4 for small-sized sheets be relatively shorter than a maximum roller distance D2 on the re-conveyance path R5 for large-sized sheets. That is to say, in the present embodiment, the distance D1 between the first reversing roller 181 and the second conveyance roller 194 is set shorter than a distance D3 between the second reversing roller 182 and the second conveyance roller 194. Further, the distance D1 is set shorter than the distance D2 between the first conveyance roller 193 and the second conveyance roller 194.

Figures 9A, 9B, 9C, 9D:
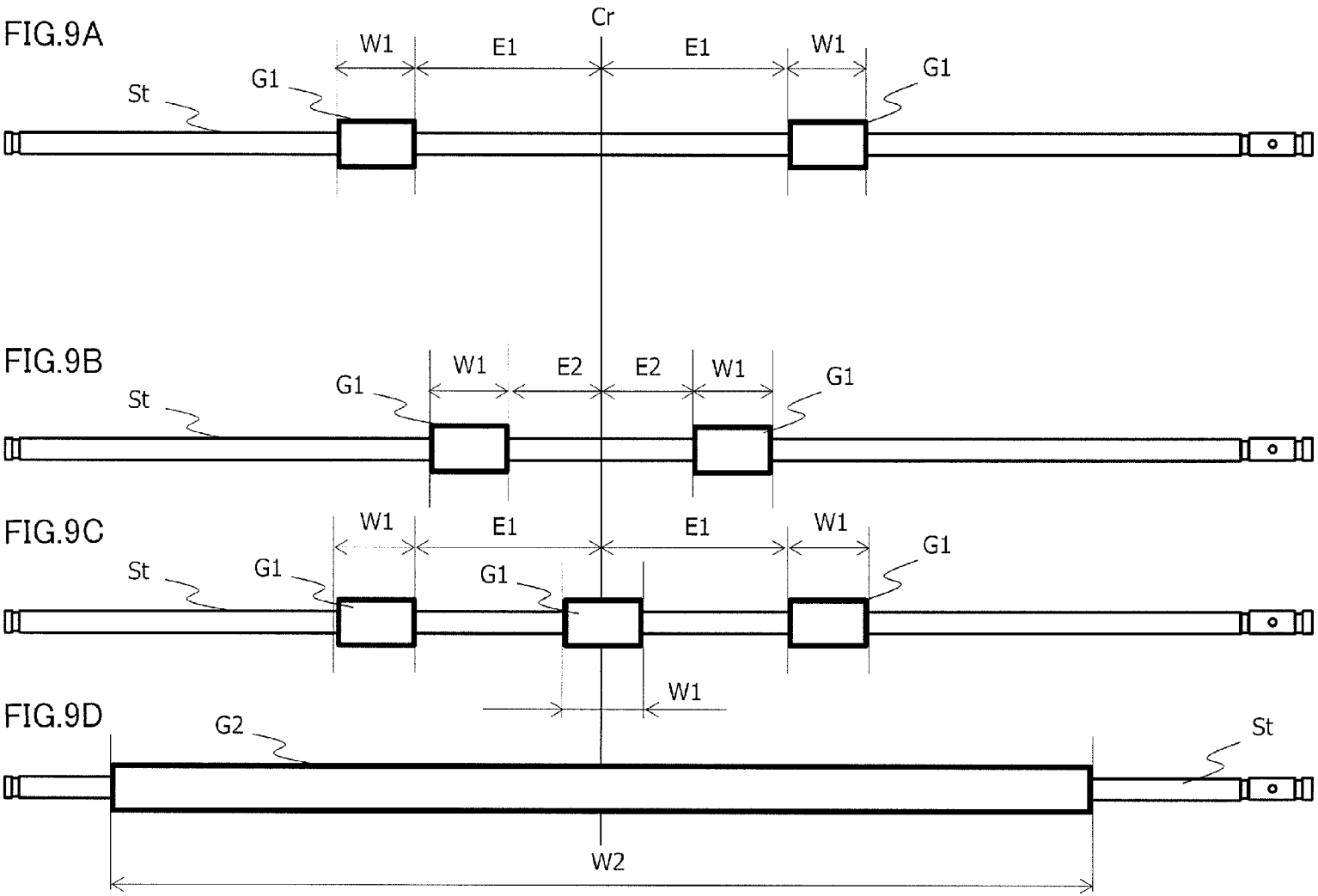
FIG. 9A illustrates a roller in the re-conveyance path for large-sized sheets.
FIG. 9B illustrates a roller in the re-conveyance path for small-sized sheets.
FIG. 9C illustrates another example of a roller in the re-conveyance path for small-sized sheets.
FIG. 9D illustrates another example of a roller in the re-conveyance path for small-sized sheets.

Next, we will describe a roller 193 and rollers 194 and 196 on the re-conveyance path with reference to FIGS. 9A to 9D. FIGS. 9A to 9D are longitudinal frame formats illustrating the roller 193 and rollers 194 and 196 shown in FIG. 8. FIG. 9A illustrates the roller 194, and FIGS. 9B, 9C and 9D illustrate an example of rollers 194 and 196. As shown in FIGS. 9A to 9D, each of the rollers 193, 194 and 196 are arranged with a shaft St as a center of rotation, and a conveyance rubber G1 or G2 arranged on the shaft St and in contact with at least one sheet.

As described above, the length of the small-sized sheet in the conveyance direction affects the distance between rollers, so in some cases, the conveyance direction is set to the longitudinal direction of the sheets in order to convey small-sized sheets using a certain inter-roller distance. In that case, the length in the direction orthogonal to the conveyance direction (axial direction) corresponds to the shorter-length direction of the sheet, which is shorter than the conveyance-direction length. In other words, it is more preferable for the area of the re-conveyance path R4 for small-sized sheets in contact with the sheets to be closer to a center of conveyance Cr of sheets with respect to the re-conveyance path R5 for large-sized sheets.

FIG. 9A illustrates the roller 193 in the re-conveyance path R5 for large-sized sheets, wherein the conveyance rubbers G1 having a width W1 are arranged on the shaft St at a distance E1 from the center of conveyance Cr of the sheets. At this time, the distance E1 is set shorter than half the length of a sheet having the shortest orthogonal length to the sheet conveyance direction among the sheets conveyed along the re-conveyance path R5 for large-sized sheets.

FIG. 9B illustrates an example of rollers 194 and 196 in the re-conveyance path R4 for small-sized sheets, wherein the conveyance rubbers G1 are arranged on the shaft St at a distance E2 from the center of conveyance Cr of the sheets. By setting the distance E2 shorter than the distance E1, it becomes possible to correspond to small-sized sheets by having the contact portion with sheets arranged closer to the center of conveyance Cr.

As another example of rollers 194 and 196, FIG. 9C illustrates forming a contact portion with the sheets near the center of conveyance Cr by increasing the number of conveyance rubbers G1, to correspond to small-sized sheets. That is to say, in FIG. 9C, the number of conveyance rubbers G1 of rollers 194 and 196 is greater than the number of conveyance rubbers G1 of the roller 193.

As described, in the example illustrated in FIGS. 9A to 9C, each of the rollers 193 to 196 has a plurality of conveyance rubbers (conveyance portions) G1 disposed at predetermined intervals along the rotational shaft St. Then, as shown in FIGS. 9B and 9C, the plurality of conveyance rubbers G1 of the rollers 194 and 196 are set so that the axial distance between the plurality of conveyance rubbers G1 is set narrower than the axial distance between the conveyance rubbers G1 of the roller 193 illustrated in FIG. 9A.

On the other hand, FIG. 9D uses a conveyance rubber G2 having a width W2 widened so that the contact portion with the sheets covers that whole conveyance area so as to correspond to small-sized sheets. That is to say, the axial-direction width of the conveyance rubber G2 of the rollers 194 and 196 is set longer than the axial-direction width of the conveyance rubber G1 of the roller 193.

According to the present embodiment, the roller 193 is arranged on the re-conveyance path, but if the distance D3 from the second reversing roller 182 to the second conveyance roller 194 is shorter than the sheet having the shortest length in the conveyance direction among the sheets conveyed on the re-conveyance path R5 for large-sized sheets, and if the second reversing roller 182 is capable of conveying the sheet on the re-conveyance path R5 for large-sized sheets to the second conveyance roller, the arrangement of the roller 193 is not indispensable.

As described, according to the present embodiment, compared to the first embodiment, the re-conveyance path R5 for large-sized sheets enables circulation conveyance of sheets having larger sizes, and at the same time, the re-conveyance path R4 for small-sized sheets can cope with duplex conveyance of smaller-sized sheets. By adopting the present invention, it becomes possible to optimize the correspondence to above-described conflicting requests individually.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2014-257421, filed Dec. 19, 2014, and 2015-232328, filed Nov. 27, 2015 which are hereby incorporated by reference herein in their entirety.

What is claimed is:

1. An image forming apparatus comprising:

an image forming portion configured to form an image on a sheet;

a first sheet conveyance path configured to guide the sheet to the image forming portion;

a second sheet conveyance path configured to guide the sheet on which an image has been formed by the image forming portion;

a re-conveyance path connecting the second sheet conveyance path and the first sheet conveyance path;

a first rotary member configured for bidirectional rotation and arranged at an end portion of the second sheet conveyance path, the first rotary member being configured to reverse the sheet on the second sheet conveyance path and directly convey the sheet to the re-conveyance path from the second sheet conveyance path;

a connecting path connecting a point on the way of the second sheet conveyance path with a point on the way of the re-conveyance path;

a second rotary member configured for bidirectional rotation and arranged downstream, in a sheet conveying direction, of a branching point where the connecting path branches from the second sheet conveyance path on the second sheet conveyance path, the second rotary member being configured to reverse the sheet on the second sheet conveyance path and convey the sheet to the connecting path from the second sheet conveyance path;

a guide unit arranged upstream, in the sheet conveying direction, of the second rotary member on the second sheet conveyance path, and being configured to switch between a first position guiding the sheet toward the second rotary member and a second position guiding the sheet reversed by the second rotary member toward the connecting path; and a control portion configured to control the guide unit such that the guide unit switches from the first position to the second position after a rear end of the sheet passes through the branching point and guides the sheet reversed by the second rotary member to the connecting path in a case of conveying the sheet to the re-conveyance path via the connecting path.

2. The image forming apparatus according to claim 1, wherein the control portion is configured to control the second rotary member in a case of forming images on both sides of a sheet having a second size which is smaller than a first size such that reversing of the sheet is started in response to a rear end of the sheet reaching a position located upstream of a position where a sheet having the first size starts to be reversed in the second sheet conveyance path.

3. The image forming apparatus according to claim 2, wherein the control portion controls the first rotary member when forming images on both sides of the sheet having the first size such that the sheet is reversed after the sheet has been conveyed until a part of the sheet is protruded to an exterior of the apparatus.

4. The image forming apparatus according to claim 3, further comprising a sheet discharge path branched from the second sheet conveyance path upstream, in the sheet conveyance direction, of the connecting path and discharging sheets, wherein the guide unit guides the sheet conveyed on the second sheet conveyance path to the sheet discharge path at the second position.

5. The image forming apparatus according to claim 4, wherein the guide unit comprises a first guide plane guiding the sheet to the connecting path, and a second guide plane opposite to the first guide plane and guiding the sheet to the sheet discharge path.

6. The image forming apparatus according to claim 4, wherein the first and second conveying paths are configured to extend in a vertical direction, and wherein the sheet discharge path branches to a same side with the image forming portion across the second conveying path.

7. The image forming apparatus according to claim 1, further comprising:

a sheet discharge path branched from a point on the way of the second sheet conveyance path and discharging sheets; and a discharge rotary member configured for bidirectional rotation and arranged on the discharge path.

8. The image forming apparatus according to claim 1, further comprising:

an input unit configured to input a sheet size information;

a first detection unit disposed on the second sheet conveyance path and detecting a sheet, having a first size, on which an image has been formed; and a second detection unit disposed on the second sheet conveyance path and detecting a sheet, having a second size shorter than a first size, on which an image has been formed, wherein when conveying a plurality of sheets having the first size to the re-conveyance path, the control portion reverses each sheet by the first rotary member and conveys the sheet to the re-conveyance path based on a detection signal from the first detection unit and the sheet size information from the input unit, and wherein when conveying a sheet having the second size to the connecting path, the control portion reverses the sheet having the second size by the second rotary member and conveys the sheet having the second size to the connecting path based on a detection signal from the second detection unit and the sheet size information from the input unit.

9. The image forming apparatus according to claim 8, wherein when forming images on both sides of a single sheet having the first size by the image forming portion, the control portion controls the second rotary member to convey the sheet having the first size to the connecting path.

10. The image forming apparatus according to claim 1, further comprising:

a stacking portion on which sheets are stacked; and a sheet feeding portion feeding the sheets stacked on the stacking portion to the first sheet conveyance path, wherein the control portion controls the first and second rotary members and the guide unit such that when forming images on both sides of a plurality of sheets having a first size by the image forming portion, a sheet having the first size fed from the sheet feeding portion and another sheet having the first size conveyed through the re-conveyance path after being reversed by the first reverse conveyance portion are passed alternately through the first sheet conveyance path, and when forming images on both sides of a plurality of sheets having a second size shorter than the first size by the image forming portion, a sheet having the second size fed from the sheet feeding portion and another sheet having the second size conveyed through the connecting path and the re-conveyance path after being reversed by the second reverse conveyance portion are passed alternately through the first sheet conveyance path.

11. The image forming apparatus according to claim 1, wherein the first rotary member is configured to discharge a sheet having passed through the second sheet conveyance path from the apparatus.

12. The image forming apparatus according to claim 1, further comprising a third rotary member arranged on the re-conveyance path and configured to be passed by the sheet being reversed and conveyed from the second rotary member, wherein a distance between the second rotary member and the third rotary member is shorter than a distance between the first rotary member and the third rotary member.

13. The image forming apparatus according to claim 12, further comprising a fourth rotary member arranged closest to the first rotary member on the re-conveyance path and configured to be passed by the sheet being reversed and conveyed from the first rotary member, wherein a distance between the second rotary member and the third rotary member is shorter than a distance between the third rotary member and the fourth rotary member.

14. The image forming apparatus according to claim 13, wherein each of the third and fourth rotary members comprises a plurality of conveyance portions disposed along a rotary shaft with predetermined intervals each other, and the plurality of conveyance portions of the third rotary member is set such that a distance in an axial direction between the plurality of conveyance portions is narrower than a distance in the axial direction between the conveyance portions of the fourth rotary member.

15. The image forming apparatus according to claim 14, wherein a number of the conveyance portions of the third rotary member is greater than a number of the conveyance portions of the fourth rotary member.

16. The image forming apparatus according to claim 13, wherein each of the third and fourth rotary members comprise a conveyance portion arranged on a rotary shaft, and a width in an axial direction of the conveyance portion of the third rotary member is set longer than a width in the axial direction of the conveyance portion of the fourth rotary member.

17. The image forming apparatus according to claim 1, wherein the control portion controls the conveyance unit such that when forming images on both sides of a plurality of sheets having the first size by the image forming portion, a sheet having the first size fed from the sheet feeding portion and a sheet having the first size conveyed through the re-conveyance path without passing the connecting path after being reversed by the first reverse conveyance portion are passed alternately through the first sheet conveyance path, and when forming images on both sides of a plurality of sheets having the second size shorter than the first size by the image forming portion, a sheet having the second size fed from the sheet feeding portion and a sheet having the second size conveyed through the connecting path and the re-conveyance path after being reversed by the conveyance unit are passed alternately through the first sheet conveyance path.

18. An image forming apparatus comprising:

a stacking portion on which sheets are stacked;

an image forming portion configured to form an image on a sheet;

a first sheet conveyance path through which the sheet moving toward the image forming portion passes;

a sheet feeding portion configured to feed the sheets stacked on the stacking portion to the first sheet conveyance path;

a second sheet conveyance path through which the sheet onto which an image has been formed by the image forming portion passes;

a re-conveyance path connecting the second sheet conveyance path and the first sheet conveyance path;

a conveyance unit conveying the sheet from the second sheet conveyance path to the re-conveyance path;

a connecting path connecting a point on the way of the second sheet conveyance path and a point on the way of the re-conveyance path; and a control portion configured to control the conveyance unit such that in a case that the image forming portion forms images on both sides of a plurality of sheets having a first size, a sheet having the first size fed from the sheet feeding portion and another sheet having the first size conveyed through the re-conveyance path without passing the connecting path after being conveyed by the conveyance unit are passed alternately through the first sheet conveyance path, and in a case that the image forming portion forms images on both sides of a plurality of sheets having a second size shorter than the first size, a sheet having the second size fed from the sheet feeding portion and another sheet having the second size conveyed through the connecting path and the re-conveyance path after being conveyed by the conveyance unit are passed alternately through the first sheet conveyance path.

19. The image forming apparatus according to claim 18, wherein the conveyance unit comprises a first rotary member capable of bidirectional rotation and arranged on the second sheet conveyance path, and a second rotary member capable of bidirectional rotation and arranged upstream in the sheet conveyance direction of the first rotary member on the second sheet conveyance path, wherein in the case that the image forming portion forms images on both sides of the sheet having the first size, the control portion controls the first rotary member such that the sheet conveyed on the second sheet conveyance path is reversed and conveyed to the re-conveyance path, and wherein in the case that the image forming portion forms images on both sides of the sheet having the second size smaller than the first size, the control portion controls the second rotary member such that the sheet conveyed on the second sheet conveyance path is reversed and conveyed to the connecting path.

20. The image forming apparatus according to claim 19, further comprising a guide unit arranged upstream, in the sheet conveying direction, of the second rotary member on the second sheet conveyance path, and being configured to switch between a first position guiding the sheet toward the second rotary member and a second position guiding the sheet reversed by the second rotary member toward the connecting path.

21. The image forming apparatus according to claim 18, further comprising a sheet discharge path branched from the second sheet conveyance path and through which the sheet onto which an image has been formed passes; and a sheet discharge portion configured to discharge the sheet conveyed through the sheet discharge path.

22. The image forming apparatus according to claim 21, wherein the first and second conveying paths are configured to extend in a vertical direction, and the sheet discharge path branches to a same side with the image forming portion across the second conveying path.

23. The image forming apparatus according to claim 18, wherein the sheet discharge path is branched from the second sheet conveyance path upstream, in a sheet conveyance direction where the sheet moving toward the conveyance unit conveys, of the point on the second sheet conveyance path at which the connecting path connects.

24. The image forming apparatus according to claim 18, wherein the sheet feeding portion is configured to feed the respective sheets stacked on the stacking portion to have a first end of the sheet be a leading edge, and in a case that the image forming portion forms an image only on a first side of the sheet, the image forming portion forms an image on the sheet in a condition in which the sheet fed from the sheet feeding portion is conveyed while keeping a relationship between the first end of the sheet and the leading edge.

25. The image forming apparatus according to claim 18, wherein the other sheet having the first size is present on the re-conveyance path when the image forming portion forms an image on the sheet having the first size fed from the sheet feeding portion, and the other sheet having the second size is present on the re-conveyance path when the image forming portion forms an image on the sheet having the second size fed from the sheet feeding portion.

* * * * *